US006895628B1

(12) United States Patent
Anderson

(10) Patent No.: US 6,895,628 B1
(45) Date of Patent: May 24, 2005

(54) MULTIPLE IMPLEMENT MAKEUP APPLICATOR

(76) Inventor: Melissa A. Anderson, 512 Fifth Ave., Lyndhurst, NJ (US) 07071

( * ) Notice: Subject to any disclaimer, the term of this patent is extended or adjusted under 35 U.S.C. 154(b) by 55 days.

(21) Appl. No.: 10/439,793

(22) Filed: May 15, 2003

(51) Int. Cl.[7] ..... A47L 13/12; A46B 15/00; A45D 40/24

(52) U.S. Cl. ..... 15/106; 15/184; 15/176.3; 132/313; 132/314; 132/317

(58) Field of Search ..... 15/106, 184, 436, 15/176.3; 401/28, 29, 31; 132/313, 314, 317; 221/303, 306, 307

(56) References Cited

U.S. PATENT DOCUMENTS 1,623,509 A * 4/1927 Vivaudou ..... 401/31
2,142,312 A * 1/1939 Heinrich ..... 401/56
2,544,130 A * 3/1951 Boothroyd ..... 15/184
2,631,321 A * 3/1953 Mureau ..... 15/184
3,001,531 A * 9/1961 Gazdik ..... 401/49
3,320,962 A * 5/1967 Moriber et al. ..... 401/31
D276,192 S * 11/1984 Fusco ..... D4/120
5,056,179 A * 10/1991 Capponi ..... 15/105
5,109,877 A * 5/1992 Takeda ..... 132/218
D401,419 S * 11/1998 Hartmann et al. ..... D4/135
5,926,903 A * 7/1999 Kim ..... 15/176.2

* cited by examiner

*Primary Examiner*—Robert J. Warden, Sr.
*Assistant Examiner*—Laura C Cole

(57) ABSTRACT

Multiple implement makeup applicators provide access to multiple makeup application implements releasably secured within a case. A plurality of locking mechanisms releasably secure a plurality of implements within tubes enclosed by a case. The case has a lid that closes it when it is not in use. The locking mechanisms consist of a locking pin with a locking pin tab on one end with its opposing end slidably inserted through a guide slot and a tube slot into a locking pin receiving channel. A spring encircling the opposing end of the locking pin pushes it into the sidewall of the tube to engage the locking mechanism.

18 Claims, 3 Drawing Sheets

MULTIPLE IMPLEMENT MAKEUP APPLICATOR

BACKGROUND OF THE INVENTION

1. Field of the Invention

The present invention relates to a multiple implement makeup applicator for use in connection with applying cosmetics. The multiple implement makeup applicator has particular utility in connection with providing access to multiple makeup application implements releasably secured within a case.

2. Description of the Prior Art

Multiple implement makeup applicators are desirable for providing access to multiple makeup application implements releasably secured within a case. A variety of cosmetic application devices with various use purposes are known and are generally provided as separate units. As a result, the user typically has to carry multiple cosmetic application devices to meet her personal appearance needs. Multiple implement makeup applicators greatly simplify matters by allowing the user to carry a single case housing multiple makeup application implements. The multiple implement makeup applicator is constructed so that the makeup application implements are retracted within the case when they are not in use. The makeup application implements can be easily removed from the case and replaced with alternative makeup application implements as desired by the user.

The use of make-up brush devices is known in the prior art. For example, U.S. Pat. No. 5,109,877 to Takeda discloses a make-up brush device. However, the Takeda '877 patent does not allow access to multiple implements simultaneously, and has further drawbacks of not allowing the user to easily remove and replace one implement with another.

U.S. Pat. No. 5,056,179 to Capponi discloses a cosmetic applicator with plural applicator elements that embodies two cosmetic applicator elements in a single barrel housing. However, the Capponi '179 patent does not allow the user to easily remove and replace one implement with another, and additionally does not have all end openings covered when it is not in use.

Similarly, U.S. Pat. No. 3,320,962 to Moriber et al. discloses a cosmetic holder and applicator that retains a plurality of commonly-used cosmetics and presents them, selectively, as needed. However, the Moriber et al. '962 patent does not have all end openings covered when it is not in use, and cannot have multiple implements protruding from one end simultaneously.

In addition, United States Patent Number Des. 276,192 to Fusco discloses a brush or similar article that has a plurality of retractable brushes. However, the Fusco '192 patent does not have a lid, and also does not have tubes within the case.

Furthermore, U.S. Pat. No. 3,001,531 to Gazdik discloses a multi-color lipstick and lip rouge applicator that dispenses selectively a relatively soft molded composition for application to the lips or to the outline of the lips. However, the Gazdik '531 patent does not allow multiple implements to protrude from one end simultaneously, and further lacks a lid.

U.S. Pat. No. 2,631,321 to Mureau discloses a make-up applicator that provides a case with a retractable brush. However, the Mureau '321 patent does not have the ability to have multiple implements protrude from one end simultaneously, and has the additional deficiency of lacking multiple implements.

Lastly, United States Patent Number Des. 401,419 to Hartmann et al. discloses a retractable detail brush with cap that encloses two brushes within its opposing ends. However, the Hartmann et al. '419 patent does not allow multiple implements to protrude from one end simultaneously, and also does not have all end openings covered when it is not in use.

While the above-described devices fulfill their respective, particular objectives and requirements, the aforementioned patents do not describe a multiple implement makeup applicator that allows providing access to multiple makeup application implements releasably secured within a case. The Takeda '877 patent makes no provision for accessing multiple implements simultaneously. The Takeda '877 patent and the Capponi '179 patent do not allow the user to easily remove and replace one implement with another. The Capponi '179 patent, the Moriber et al. '962 patent, and the Hartmann et al. '419 patent do not have all end openings covered when they are not in use. The Moriber et al. '962 patent, the Gazdik '531 patent, the Mureau '321 patent, and the Hartmann et al. '419 patent cannot have multiple implements protruding from one end simultaneously. The Fusco '192 patent and the Gazdik '531 patent lack a lid. The Fusco '192 patent does not have tubes within the case. The MuTeau '321 patent lacks multiple implements.

Therefore, a need exists for a new and improved multiple implement makeup applicator that can be used for providing access to multiple makeup application implements releasably secured within a case. In this regard, the present invention substantially fulfills this need. In this respect, the multiple implement makeup applicator according to the present invention substantially departs from the conventional concepts and designs of the prior art, and in doing so provides an apparatus primarily developed for the purpose of providing access to multiple makeup application implements releasably secured within a case.

SUMMARY OF THE INVENTION

In view of the foregoing disadvantages inherent in the known types of make-up brush devices now present in the prior art, the present invention provides an improved multiple implement makeup applicator, and overcomes the above-mentioned disadvantages and drawbacks of the prior art. As such, the general purpose of the present invention, which will be described subsequently in greater detail, is to provide a new and improved multiple implement makeup applicator which has all the advantages of the prior art mentioned heretofore and many novel features that result in a multiple implement makeup applicator which is not anticipated, rendered obvious, suggested, or even implied by the prior art, either alone or in any combination thereof.

To attain this, the present invention essentially comprises a case with a closed end, an open end, and a sidewall. A base has one side attached to the closed end of the case, and a plurality of tubes have one end attached to the opposing side of the base. A plurality of implements have one end removably inserted into the tubes.

There has thus been outlined, rather broadly, the more important features of the invention in order that the detailed description thereof that follows may be better understood and in order that the present contribution to the art may be better appreciated.

The invention may also include a plurality of screw bases with one end attached to the end of the implements. The tubes may have a slot in their sidewall to comprise tube slots. There may be slots in the sidewall of the case to comprise guide slots. There may be locking mechanisms connected to the side of the screw bases and protruding from the guide slots. A locking mechanism may comprise a locking pin receiving channel in the form of a slot in the side of a screw base, a locking pin having one end slidably inserted into the locking pin receiving channel and the tube slot and its opposing end protruding from the guide slot, and a spring encircling the end of the locking pin. The locking pin receiving channel may be roughly T-shaped in cross-section. The end of the screw bases may be threadedly attached to the end of the implements. The implements may be powder brushes, blush brushes, large eyeshadow brushes, small eyeshadow brushes, lip brushes, concealer brushes, brow brushes, dust brushes, and lash mascara wands. There may be a lid hingedly attached to the sidewall of the case adjacent to the open end of the case. The case and lid may be cylindrical in shape. The case, lid, and tubes may be made of plastic, steel, aluminum, titanium, wood, or carbon fiber composite. The screw bases maybe slidably inserted into the tubes. The implements may have one end removably inserted into the screw bases. The locking mechanisms maybe slidably inserted through the guide slots and the tube slots and connected to the side of the screw bases. The locking mechanisms may releasably secure the implements within the tubes when the locking pins are adjacent to the base. The end of the locking pin may be roughly T-shaped in cross-section. There may be a locking pin tab attached to the opposing end of the locking pin. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multiple implement makeup applicator that has all of the advantages of the prior art make-up brush devices and none of the disadvantages.

It is another object of the present invention to provide a new and improved multiple implement makeup applicator that may be easily and efficiently manufactured and marketed.

An even further object of the present invention is to provide a new and improved multiple implement makeup applicator that has a low cost of manufacture with regard to both materials and labor, and which accordingly is then susceptible of low prices of sale to the consuming public, thereby making such multiple implement makeup applicator economically available to the buying public.

Still another object of the present invention is to provide a new multiple implement makeup applicator that provides in the apparatuses and methods of the prior art some of the advantages thereof, while simultaneously overcoming some of the disadvantages normally associated therewith.

Even still another object of the present invention is to provide a multiple implement makeup applicator for providing access to multiple makeup application implements releasably secured within a case. This allows the user to have a full range of makeup application implements available while only carrying one device.

Still yet another object of the present invention is to provide a multiple implement makeup applicator for providing access to multiple makeup application implements releasably secured within a case. This makes it possible for the user to remove and replace makeup application implements from the multiple implement makeup applicator as desired.

An additional object of the present invention is to provide a multiple implement makeup applicator for providing access to multiple makeup application implements releasably secured within a case. This ensures that any residual makeup on the implements cannot escape from the case when the multiple implement makeup applicator is not in use.

A further object of the present invention is to provide a multiple implement makeup applicator for providing access to multiple makeup application implements releasably secured within a case. This allows multiple implements to protrude from the end of the case simultaneously.

Lastly, it is an object of the present invention to provide a new and improved multiple implement makeup applicator for providing access to multiple makeup application implements releasably secured within a case.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
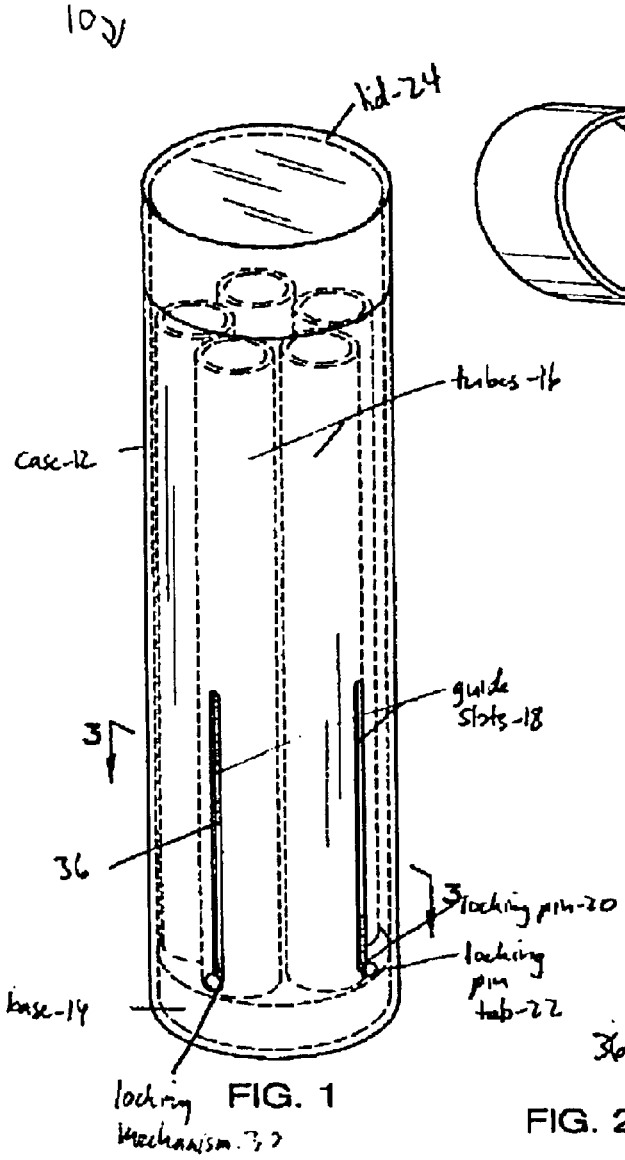
FIG. 1 is a top perspective view of the current embodiment of the multiple implement makeup applicator constructed in accordance with the principles of the present invention.

Referring now to the drawings, and particularly to FIGS. 1–5, a current embodiment of the multiple implement makeup applicator of the present invention is shown and generally designated by the reference numeral 10.

In FIG. 1, a new and improved multiple implement makeup applicator 10 of the present invention for providing access to multiple makeup application implements releasably secured within a case is illustrated and will be described. More particularly, the multiple implement makeup applicator 10 has a case 12 with an open end and a closed end. A base 14 is attached to the closed end of case 12. A plurality of tubes 16 have one end attached to base 14. A lid 24 removably covers the open end of case 12. In the current embodiment, case 12, tube 16, and lid 24 are made of plastic, and case 12 and lid 24 are cylindrical in shape. Guide slots 18 are cut in the sidewall of case 12. Locking pins 20 with locking pin tabs 22 are visible protruding from guide slots 18. The multiple implement makeup applicator 10 is shown in its storage position with locking mechanisms 30 releasably securing implements 26 (not shown) within tubes 16 and lid 24 in its closed position.

Figure 2:
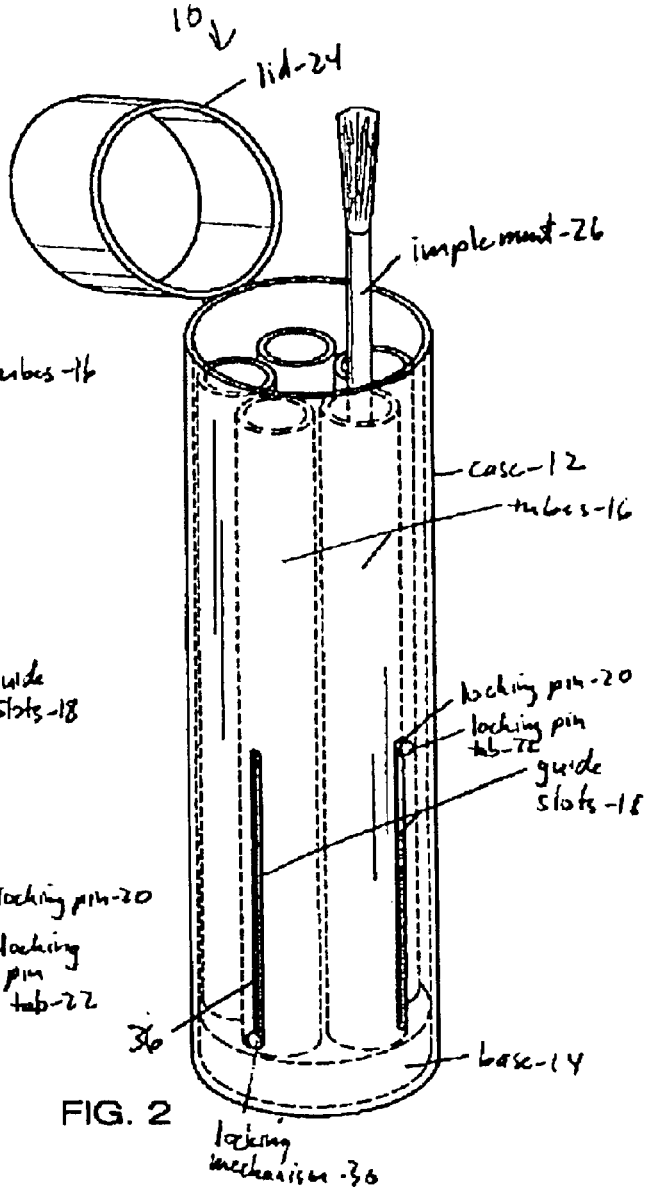
FIG. 2 is a top perspective view of the multiple implement makeup applicator of the present invention.

Moving on to FIG. 2, a new and improved multiple implement makeup applicator 10 of the present invention for providing access to multiple makeup application implements releasably secured within a case is illustrated and will be described. More particularly, the multiple implement makeup applicator 10 has a case 12 enclosing a base 14 and tubes 16. The multiple implement makeup applicator 10 is shown in its in use position with lid 24 in its open position and one locking mechanism 30 in its unlocked position, thereby allowing implement 26 to protrude from tubes 16 once locking pin 20 with locking pin tab 22 has been slid upward within guide slot 18. In the current embodiment, lid 24 is hingedly attached to the sidewall of case 12 adjacent to case's 12 open end. In this instance, implement 26 is a lip brush.

Figure 3:
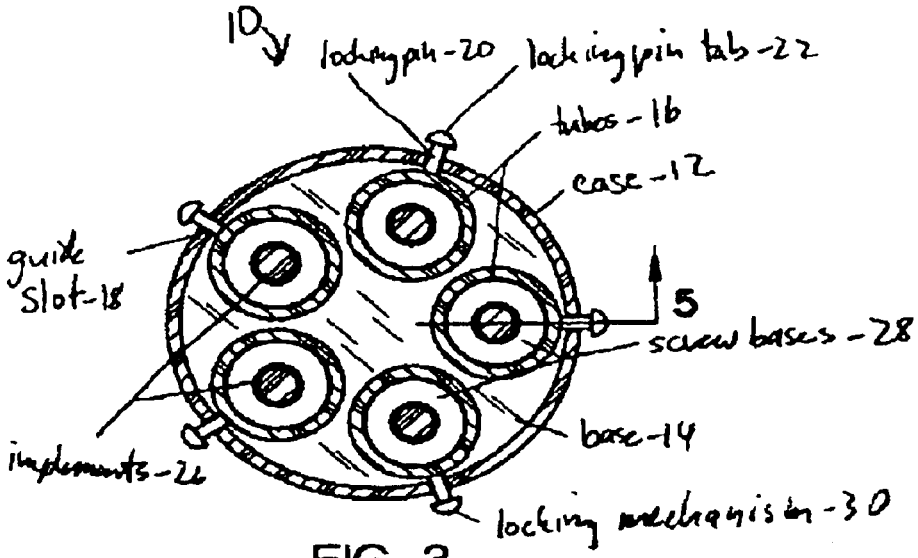
FIG. 3 is a top side view of the multiple implement makeup applicator of the present invention.

Continuing with FIG. 3, a new and improved multiple implement makeup applicator 10 of the present invention for providing access to multiple makeup application implements releasably secured within a case is illustrated and will be described. More particularly, the multiple implement makeup applicator 10 has a plurality of tubes 16 attached to a base 14 within case 12. The implements 26 are releasably secured within tubes 16 by locking mechanisms 30. Locking mechanisms 30 include locking pins 20 with locking pin tabs 22 attached to one end. Locking pins 20 protrude from guide slots 18 in the sidewall of case 12.

Figure 4:
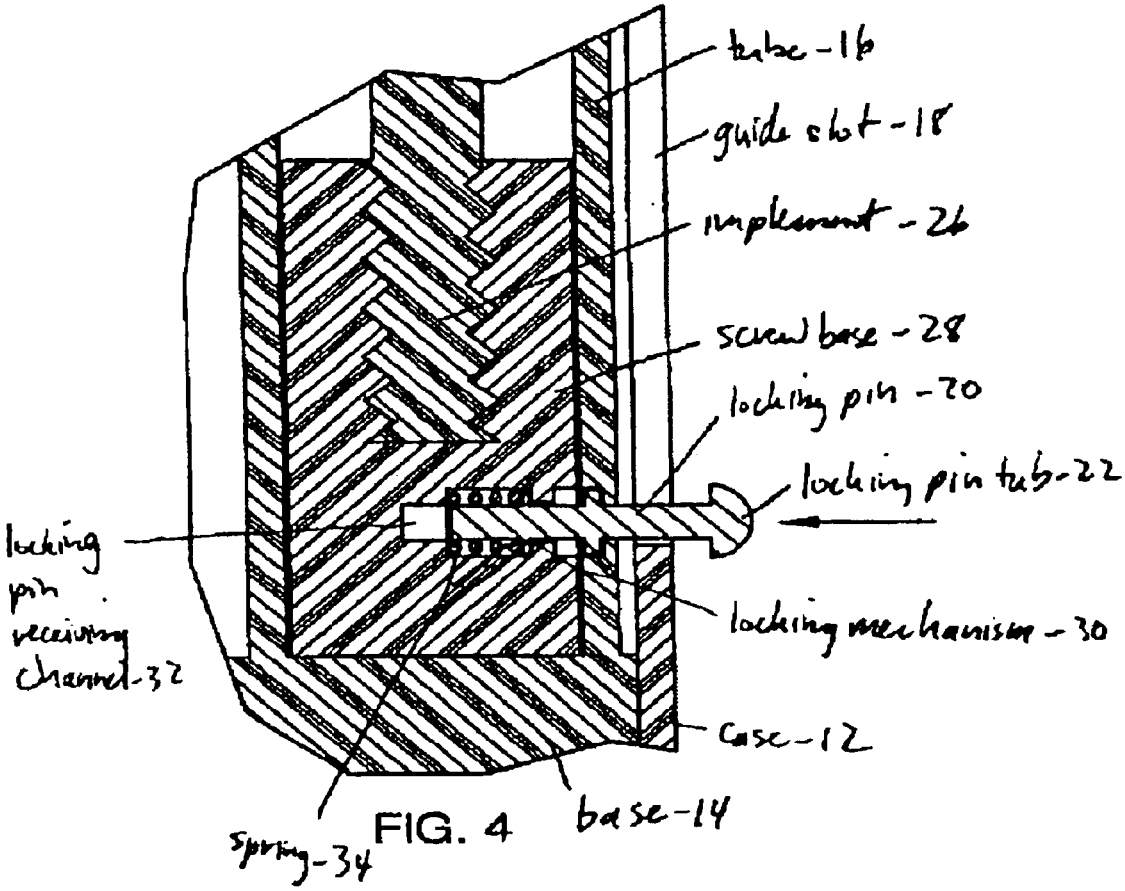
FIG. 4 is a side sectional view of the locking mechanism of the present invention.

In FIG. 4, a new and improved locking mechanism 30 of the present invention for providing access to multiple makeup application implements releasably secured within a case is illustrated and will be described. More particularly, the locking mechanism 30 has a locking pin 20 slidably inserted through tube slot 36 into locking pin receiving channel 32. A spring 34 encircles one end of locking pin 20. The locking pin receiving channel 32 and the end of locking pin 20 are generally T-shaped in cross-section. In its current position, locking mechanism 30 is in its locked position with spring 34 having pushed locking pin 20 into the sidewall of tube 16, thereby preventing locking pin 20 from moving within tube slot 36 and guide slot 18. By pressing on locking pin tab 22, locking pin 20 depresses spring 34 and is forced into locking pin receiving channel 32, thereby allowing locking pin 20 to slide within tube slot 36 and guide slot 18. Sliding locking pin 20 upward causes screw base 28 to rise, thereby pushing implement 26 out of the top of tube 16 and into its in use position. Implement 26 is threadedly attached to screw base 28, thereby allowing implement 26 to be removed from screw base 28 and a different implement 26 to be installed.

Figure 5:
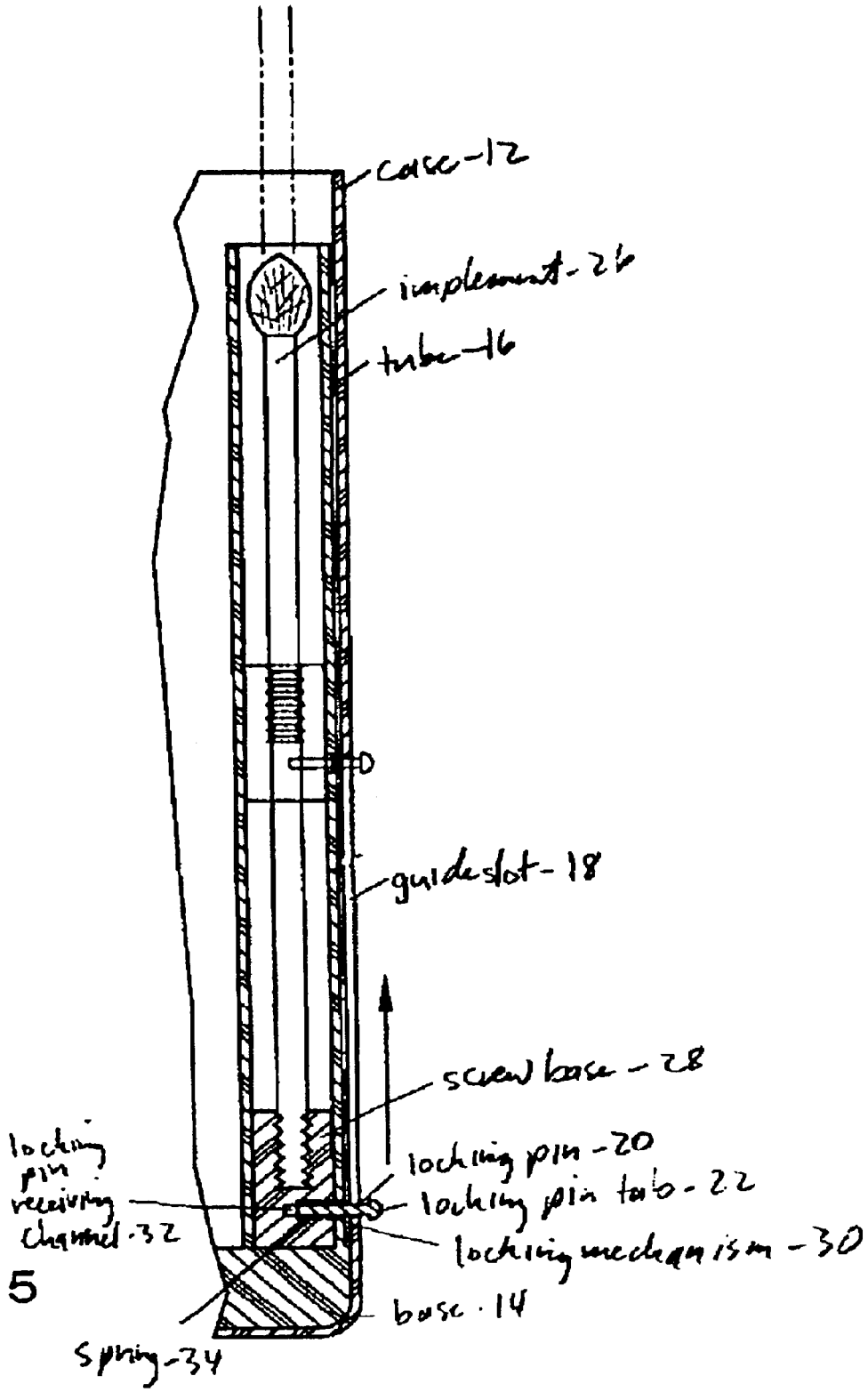
FIG. 5 is a side sectional view of the tube of the present invention.

Concluding with FIG. 5, a new and improved tube 16 of the present invention for providing access to multiple makeup application implements releasably secured within a case is illustrated and will be described. More particularly, the tube 16 has a screw base 28 slidably inserted within it. One end of tube 16 is attached to base 14, and base 14 and tubes 16 are enclosed by case 12. The arrow and broken lines illustrate how unlocking locking mechanism 30 and sliding locking pin 20 with locking pin tab 22 upward within tube slot 36 and guide slot 18 causes screw base 28 to rise and implement 26 to extend from the top of tube 16 and case 12 into its in use position. The locking pin receiving channel 32 and spring 34 components of locking mechanism 30 are also shown.

In use, it can now be understood that the user selects which implements 26 she desires to carry within case 12 and installs them by screwing them into screw bases 28. When the multiple implement makeup applicator 10 is not in use, case 12 is closed by lid 24, and implements 26 are retracted into tubes 16 and releasably secured in place by locking mechanism 30. When the user wishes to make use of an implement 26, she first opens lid 24 and then depresses the locking pin tab 22 for the desired implement, thereby unlocking locking mechanism 30 by pushing locking pin 20 into locking pin receiving channel 32. The user then slides locking pin 20 upward within tube slot 36 and guide slot 18, thereby causing screw base 28 to rise and implement 26 to be extended from tubes 16 and case 12. The user then makes use of the implement 26 as desired. Upon concluding, the user slides locking pin 20 downward within tube slot 36 and guide slot 18 until spring 34 pushes locking pin 20 into the sidewall of tube slot 36, thereby engaging locking mechanism 30. The user then closes lid 24.

While a current embodiment of the multiple implement makeup applicator has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as steel, aluminum, titanium, wood, or carbon fiber composite may be used instead of the plastic lid, case, and tubes described. Also, the cylindrical lid and case may also be made in many other shapes. And although providing access to multiple makeup application implements releasably secured within a case has been described, it should be appreciated that the multiple implement makeup applicator herein described is also suitable for providing access to a wide variety of other implements, such as paintbrushes. Furthermore, a wide variety of makeup application implements may be used instead of the powder brushes, blush brushes, large eyeshadow brushes, small eyeshadow brushes, lip brushes, concealer brushes, brow brushes, dust brushes, and lash mascara wands described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multiple implement makeup applicator comprising:

a case having a closed end, an open end, and a sidewall;

a base having opposing sides with one side attached to said closed end of said case;

a plurality of tubes having opposing ends and a sidewall with one end attached to said opposing side of said base;

a plurality of implements having opposing ends with one end removably inserted into said tubes;

a plurality of screw bases having an end and a side with said end attached to said end of said implements;

a plurality of tube slots wherein said sidewall of said tubes defines a slot therein to comprise said tube slots;

a plurality of guide slots wherein said sidewall of said case defines slots therein to comprise said guide slots; and a plurality of locking mechanisms connected to said side of said screw bases and protruding from said guide slots.

2. The multiple implement makeup applicator as defined in claim 1, wherein said locking mechanism comprises:

a locking pin receiving channel wherein said side of said screw base defines a slot therein to comprise said locking pin receiving channel;

a locking pin having opposing ends with one end slidably inserted into said locking pin receiving channel and said tube slot and said opposing end protruding from said guide slot; and a spring encircling said end of said locking pin.

3. The multiple implement makeup applicator as defined in claim 2, wherein said locking pin receiving channel is roughly T-shaped in cross-section.

4. The multiple implement makeup applicator as defined in claim 1, wherein said end of said screw bases is threadedly attached to said end of said implements.

5. The multiple implement makeup applicator as defined in claim 1, wherein said implements are selected from the group consisting of powder brushes, blush brushes, large eyeshadow brushes, small eyeshadow brushes, lip brushes, concealer brushes, brow brushes, dust brushes, and lash mascara wands.

6. The multiple implement makeup applicator as defined in claim 1, further comprising a lid hingedly attached to said sidewall of said case adjacent to said open end of said case.

7. The multiple implement makeup applicator as defined in claim 6, wherein said lid is cylindrical in shape.

8. The multiple implement makeup applicator as defined in claim 6, wherein said lid is selected from the group consisting of plastic, steel, aluminum, titanium, wood, and carbon fiber composite.

9. The multiple implement makeup applicator as defined in claim 1, wherein said case is cylindrical in shape.

10. The multiple implement makeup applicator as defined in claim 1, wherein said case is selected from the group consisting of plastic, steel, aluminum, titanium, wood, and carbon fiber composite.

11. The multiple implement makeup applicator as defined in claim 1, wherein said tubes are selected from the group consisting of plastic, steel, aluminum, titanium, wood, and carbon fiber composite.

12. A multiple implement makeup applicator comprising:

a case having a closed end, an open end, and a sidewall;

a lid removably covering said open end of said case;

a base having opposing sides with one side attached to said closed end of said case;

a plurality of tubes having opposing ends and a sidewall with one end attached to said opposing side of said base;

a plurality of screw bases having opposing ends and a side slidably inserted into said tubes;

a plurality of implements having opposing ends with one end removably inserted into said screw bases;

a plurality of tube slots wherein said sidewall of said tubes define a slot therein to comprise said tube slots;

a plurality of guide slots wherein said sidewall of said case defines slots therein to comprise said guide slots; and a plurality of locking mechanisms having one end slidably inserted through said guide slots and said tube slots and connected to said side of said screw bases.

13. The multiple implement makeup applicator as defined in claim 12, wherein said locking mechanism comprises:

a locking pin receiving channel wherein said side of said screw base defines a slot therein to comprise said locking pin receiving channel;

a locking pin having opposing ends with one end slidably inserted into said locking pin receiving channel and said tube slot and said opposing end protruding from said guide slot; and a spring encircling said end of said locking pin.

14. The multiple implement makeup applicator as defined in claim 13, wherein said locking mechanisms releasably secure said implements within said tubes when said locking pins are adjacent to said base.

15. The multiple implement makeup applicator as defined in claim 13, wherein said end of said locking pin is roughly T-shaped in cross-section.

16. The multiple implement makeup applicator as defined in claim 13, further comprising a locking pin tab attached to said opposing end of said locking pin.

17. A multiple implement makeup applicator comprising:

a case having a closed end, an open end, and a sidewall;

a lid hingedly attached to said sidewall of said case adjacent to said open end of said case;

a base having opposing sides with one side attached to said closed end of said case;

a plurality of tubes having opposing ends and a sidewall with one end attached to said opposing side of said base;

a plurality of implements having opposing ends with one end removably inserted into said tubes;

a plurality of screw bases having an end and a side with said end attached to said end of said implements;

a plurality of guide slots wherein said sidewall of said case defines slots therein to comprise said guide slots;

a plurality of tubes slots wherein said sidewall of said tubes defines a slot therein to comprise said tubes slots;

a plurality of locking pin receiving channels wherein said side of said screw bases defines a slot therein to comprise said locking pin receiving channels;

a plurality of locking pins having opposing ends with one end slidably inserted into said locking pin receiving channels and said tube slots and said opposing end protruding from said guide slots;

a plurality of springs encircling said end of said locking pins; and a plurality of locking pin tab process attached to said opposing end of said locking pins.

18. The multiple implement makeup applicator as defined in claim 17, wherein said implements are selected from the group consisting of powder brushes, blush brushes, large eyeshadow brushes, small eyeshadow brushes, lip brushes, concealer brushes, brow brushes, dust brushes, and lash mascara wands.

* * * * *